United States Patent [19]

Seager

[11] Patent Number: 4,702,398

[45] Date of Patent: Oct. 27, 1987

[54] PRODUCT DISPENSER WITH ADVANCE/RETRACT-TYPE DELIVERY MEANS

[75] Inventor: Richard H. Seager, Mystic, Conn.

[73] Assignee: Risdon Corporation, Naugatuck, Conn.

[21] Appl. No.: 822,036

[22] Filed: Jan. 24, 1986

[51] Int. Cl.[4] ..... B67D 5/42; B65D 35/56

[52] U.S. Cl. ..... 222/386; 222/105; 222/326; 74/521

[58] Field of Search ..... 222/386, 95, 105, 326; 16/225, 227; 401/60, 55, 82, 87; 254/122; 74/521, 106

[56] References Cited

U.S. PATENT DOCUMENTS

| | | | |
|---|---|---|---|
| 1,904,364 | 4/1933 | Fullmer . | |
| 2,793,028 | 5/1957 | Wheeler . | |
| 2,951,584 | 9/1960 | Bauer | 401/55 X |
| 3,399,909 | 9/1968 | Ambrose . | |
| 3,629,901 | 12/1971 | Wolf . | |
| 3,981,470 | 9/1976 | Rutili . | |
| 4,027,714 | 6/1977 | Dixon et al. | 16/225 X |
| 4,236,274 | 12/1980 | Omote et al. . | |
| 4,413,757 | 11/1983 | Alder | 222/105 |

FOREIGN PATENT DOCUMENTS

| | | | |
|---|---|---|---|
| 2323762 | 11/1974 | Fed. Rep. of Germany | 222/105 |
| 728945 | 11/1950 | France | 222/386 |

*Primary Examiner*—Joseph J. Rolla
*Assistant Examiner*—Gregory L. Huson
*Attorney, Agent, or Firm*—St. Onge Steward Johnston & Reens

[57] ABSTRACT

Solid or liquid products, such as deodorants are advanced for use and retracted for storage in a dispenser which includes a container, a product supporting cup slidably-mounted within the container, and a delivery mechanism to move the cup upwardly and downwardly within the container. The delivery mechanism which is integrally-formed from plastic with the cup includes a first arm and a second arm each of which have first and second ends connected by an intermediate hinge. The first ends of the first and second arms are connected to the cup with cup hinges. The first and second arms of the delivery mechanism are bent at their intermediate and cup hinges so that the first and second arms form a scissor arrangement with the first ends of the first and second arms crossing and the second ends of the first and second arms crossing. After the arms of the delivery mechanism are positioned in this scissor arrangement, the cup containing a product and the delivery mechanism are inserted into the container. The container is provided with openings through which the user can insert his fingers to manually squeeze the second ends of the first and second arms together so that the cup and product are advanced upwardly. After the product has been used, the cup and product may be retracted by releasing the squeezing pressure applied to the second ends of the first and second arms so that the second ends move apart.

34 Claims, 9 Drawing Figures

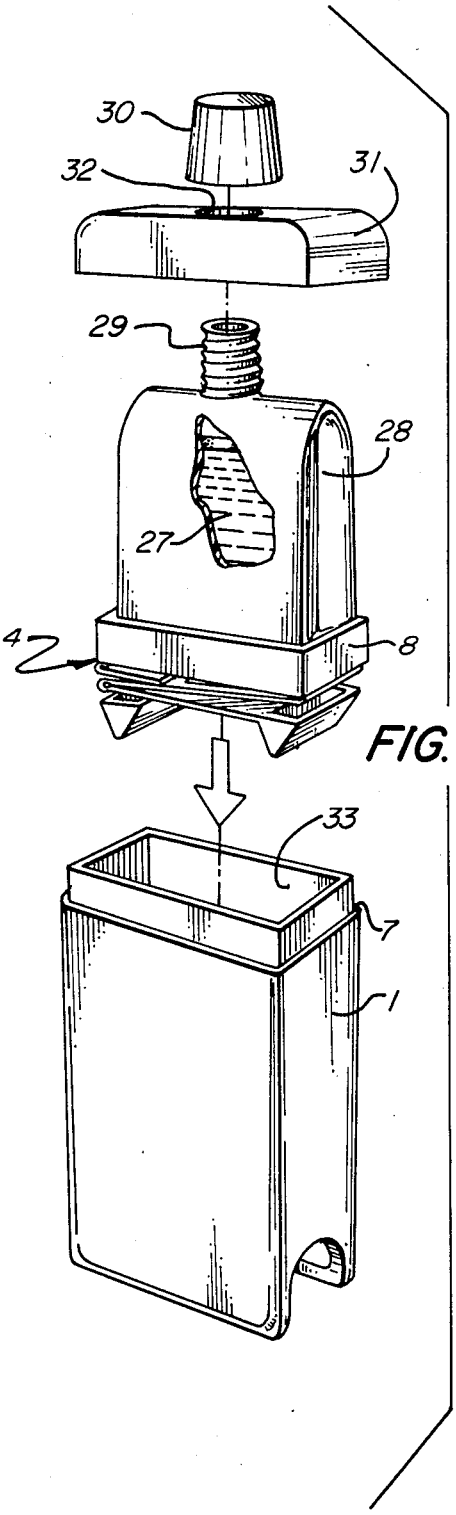
FIG. 7
FIG. 8
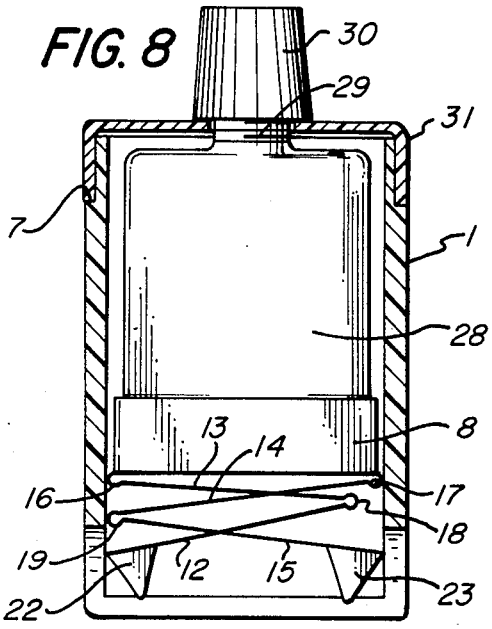
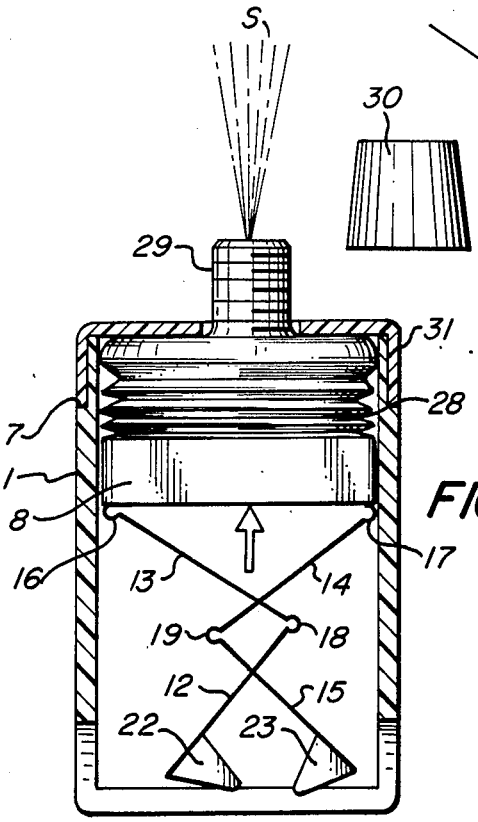
FIG. 9

PRODUCT DISPENSER WITH ADVANCE/RETRACT-TYPE DELIVERY MEANS

BACKGROUND OF THE INVENTION

It has long been desired to manufacture a product dispenser for storing a solid or liquid product, such as deodorant, when not being used and for dispensing the product when needed. It has been particularly desired to produce such a dispenser which has a simple design and which can be manufactured without significant machining or assembly to reduce fabrication costs.

Presently, products like deodorants are dispensed by aerosol sprays, rolling ball applicators, advance/retract-type dispensers, etc. Advance/retract-type dispensers are designed to store products in a retracted position within the container, and, when the product is used, a mechanism is actuated to advance the product from the container. U.S. Pat. No. 1,904,364 to Fullmer discloses one type of advance/retract-type product dispenser for cosmetics and the like. In this device, a carrier and the product therein are advanced by "lazy tongs." The links of lazy tongs are pinned at all link intersections, are not themselves manually manipulated, are not integrally-formed with hinges, and are not integrally-formed with the product carrier.

SUMMARY OF THE INVENTION

The present invention is drawn to a product dispenser of simple construction having a container, a cup for supporting the product slidably-mounted in the container, and a delivery means. The delivery means includes first and second arms each of which have first and second ends connected by an intermediate hinge. The first ends of the first and second arms are each connected to the cup by cup hinges. The cup and delivery means are integrally-formed from a suitable plastic material by a single injection molding step. Accordingly, the cup and delivery means are easily formed, and no assembly of the delivery means itself or the delivery means to the cup is required.

The integrally-formed cup and delivery means can be positioned within the container by bending the first and second arms at their respective intermediate and cup hinges to form a scissor arrangement with the first ends of the first and second arms crossing and with the second ends of the first and second arms crossing. When the delivery means is so arranged, the dispenser can be assembled by merely inserting the cup and delivery means into the interior of the container; no connections between the container and the cup or the container and the delivery means are required.

Once the cup and delivery means are inserted into the interior of the container, the user can advance the product contained in the cup for dispensing by inserting his fingers through openings at the base of the container and manually squeezing the second ends of the first and second arms together. After the product is dispensed, it may be retracted into the interior of the container when the user releases his grip on the second ends of the first and second arms so that they move apart.

The product dispenser of the present invention is useful for dispensing either solids or liquids.

BRIEF DESCRIPTION OF THE DRAWINGS

FIG. 7 is a perspective view of another embodiment of the product dispenser exploded;

FIG. 8 is a cross-sectional view of the product dispenser in FIG. 7 in a retracted position.

FIG. 9 is a cross-sectional view of the product dispenser in FIG. 7 in an advanced position.

DETAILED DESCRIPTION OF THE DRAWINGS

Figure 1:
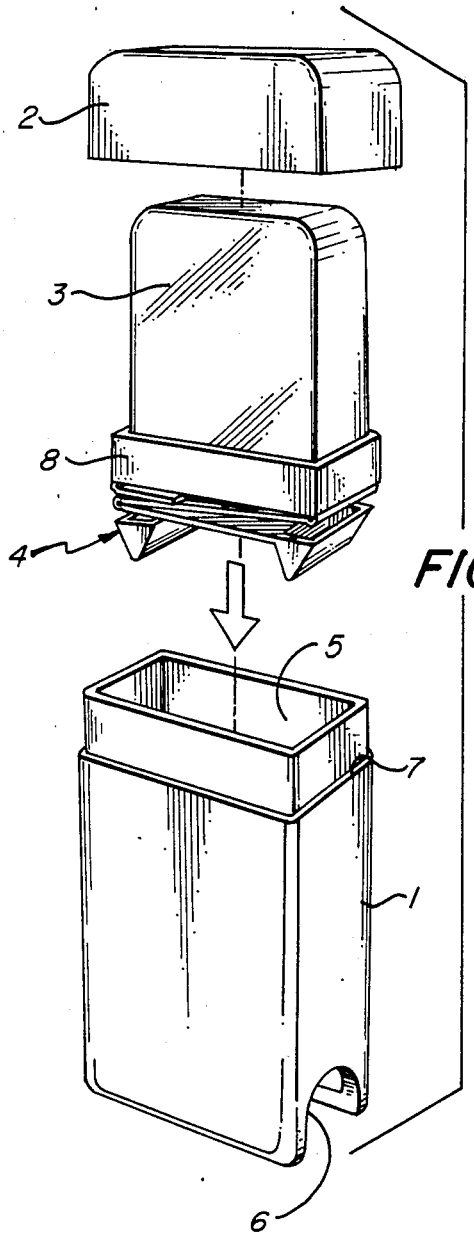
FIG. 1 is a perspective view of one embodiment of the product dispenser exploded.

FIG. 1 shows a perspective view of one embodiment of the product dispenser exploded. The product dispenser includes a container 1, a cup 8 which is slidably-supported within container 1 for supporting solid product 3, and a delivery means 4. Container 1 has a product dispensing opening 5 which is closed when cover 2 is placed on ridge 7. In addition, a manipulation opening 6 is provided at the base of container 1 to permit the user to access delivery means 4.

Figure 2:
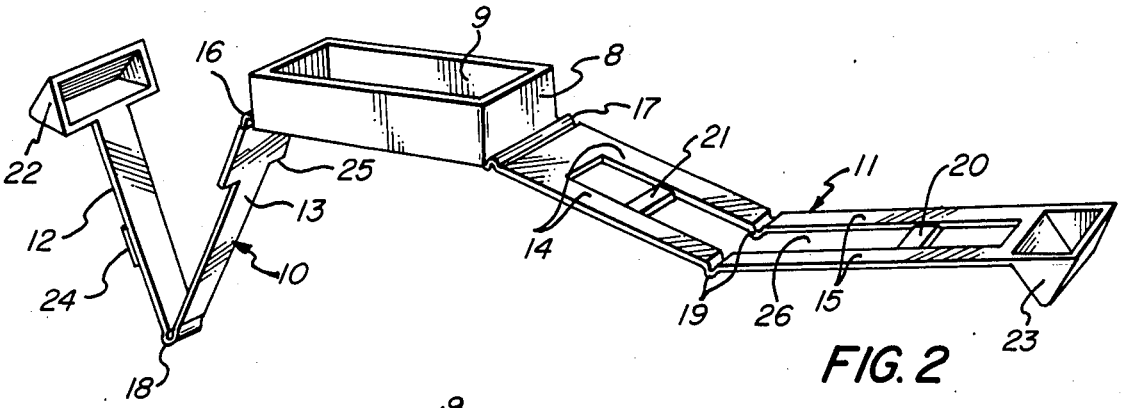
FIGS. 2–4 are perspective views of the cup and delivery means for the product dispenser showing the delivery means components being moved into their operative position.

FIG. 2 shows the delivery means and cup 8 in more detail. Cup 8, having a product holding interior 9, is attached to the delivery means at first arm 10 and at second arm 11 by first cup hinge 16 and second cup hinge 17, respectively. First arm 10 includes a first end 12 and a second end 13 which are connected by intermediate hinge 18. Second arm 11 includes first end 14 and second end 15 connected by second intermediate hinge 19.

Figure 3:
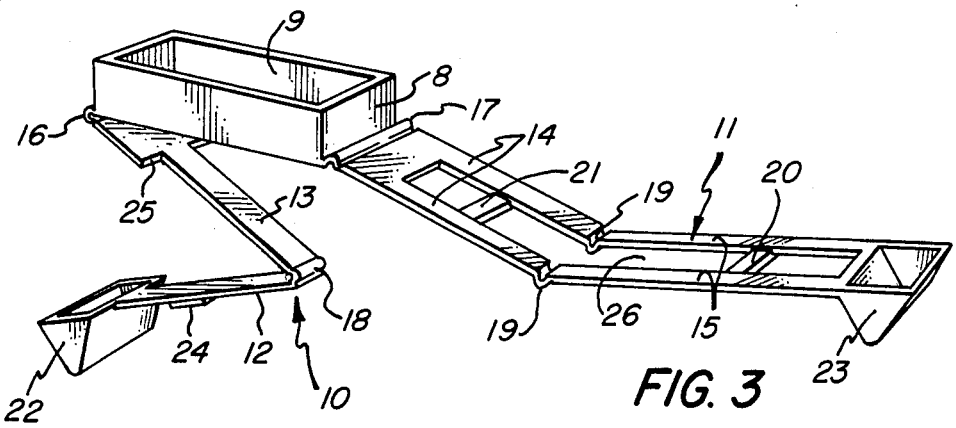
Figure 4:
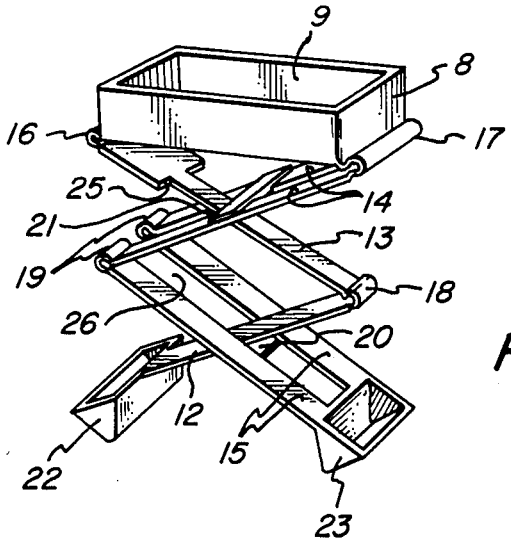

As shown by FIGS. 2–4, when viewed in sequence, first arm 10 and second arm 11 are bent at cup hinges 16 and 17 and intermediate hinges 18 and 19 so that arms 10 and 11 are positioned beneath cup 8 in a scissor arrangement. When first arm 10 and second arm 11 are positioned in this scissor arrangement, first ends 13 and 14 cross as do second ends 12 and 15. This crossing arrangement is accomplished by extending first end 13 and second end 12 into cutout portion 26 of second arm 11. Cross bars 20 and 21 extend across cutout portion 26 perpendicularly to the length of arm 11 such that cross bar 21 rests on first end 13 and second end 12 rests on cross bar 20.

The second ends of first arm 10 and second arm 11 are provided with gripping portions of triangular cross section 22 and 23, respectively. By moving gripping portions 22 and 23 together, first ends 13 and 14 and second ends 12 and 15 slidably move with respect to one another to advance cup 8 upwardly. The sliding movement of first end 14 with respect to first end 13 in advancing cup 8 upwardly is restricted by limiting projection 25, while the sliding of second end 12 with respect to second end 15 in advancing cup 8 is restricted by limiting bar 24. Cup 8 can be retracted downwardly by permitting gripping portions 22 and 23 to move apart.

A particular advantage of the present invention is that cup 8, first ends 13–14, second ends 12 and 15, cup hinges 16–17, intermediate hinges 18–19, cross bars 20–21, gripping positions 22–23, limiting bar 24, and limiting projection 25 are all integrally-formed from a plastic material by a single injection molding step. Suitable plastic materials include polypropylene or polyethylene. Accordingly, the cup and delivery means are easily formed and no assembly of the delivery means itself or the delivery means to the cup is required.

Figure 5:
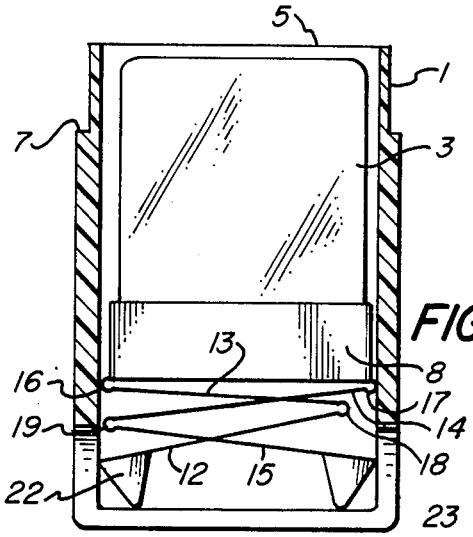
FIG. 5 is a cross-sectional view of the product dispenser in FIG. 1 when assembled with the product in a retracted position.
Figure 6:
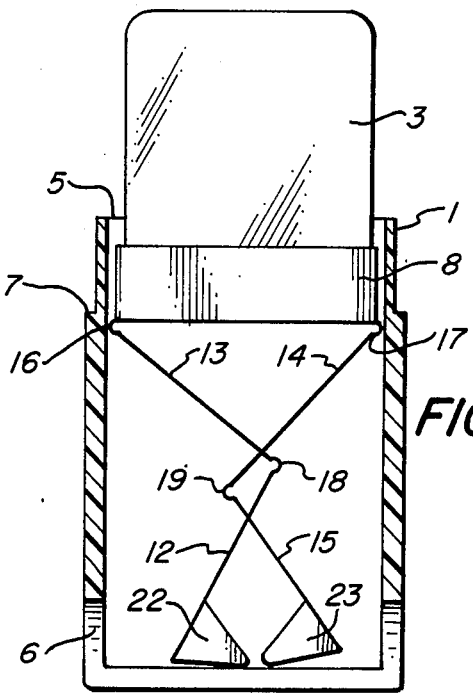
FIG. 6 is a cross-sectional view of the product dispenser in FIG. 1 when assembled with the product in an advanced position.

FIGS. 5 and 6 show a cross-sectional view of the assembly product dispenser of FIG. 1 in use. In FIG. 5, product 3 and cup 8 are retracted beneath product dispensing opening 5 of container 1. In this retracted position, first ends 13 and 14 and second ends 12 and 15 are folded tightly together with cup hinges 16 and 17 and intermediate hinges 18 and 19 bent at acute angles. Gripping portions 22 and 23 are positioned far apart.

As shown in FIG. 6, solid product 3 and cup 8 are slidably advanced upwardly through product dispensing opening 5 of container 1 by moving gripping portions 22 and 23 toward each other. This is accomplished when the user inserts his fingers through manipulation opening 6 (shown in FIG. 1) and squeezes gripping portions 22 and 23 together. In this advanced position, first ends 13 and 14 and second ends 12 and 15 are extended with cup hinges 16–17 and intermediate hinges 18–19 bent at wide angles. After dispensing is completed, product 3 and cup 8 may be retracted to the position shown in FIG. 5 by releasing the squeezing pressure on gripping portions 22 and 23 so that they move apart.

As shown in FIG. 7, liquid can also be dispensed by the present invention. In accordance with this embodiment, liquid product 27 in flexible container 28 is held within cup 8 which is integrally-formed with delivery means 4 in the above-discussed manner. Flexible container 28, cup 8, and delivery means 4 are inserted through open end 33 of container 1. When cover 31 is placed on ridge 7 of container 1, threaded spout 21 of flexible container 28 extends through opening 32 to permit cap 30 to be screwed on threaded spout 29. A strong adhesive material is applied to ridge 7 so that cover 31 permanently adheres to container 1.

When the components of the liquid product dispenser of FIG. 7 are assembled, they assume a retracted position as shown in FIG. 8. In this retracted position, hinges 16–19 are bent at acute angles, gripping portions 22–23 are spaced apart, and the scissor arrangement formed by first arms 13–14 and second arms 12 and 15 is folded tightly together. When the scissor arrangement of the delivery system is tightly folded, cup 8 supports flexible container 28 so that the container does not press against the upper surface of cover 31. Threaded spout 29 extends through an opening in cover 31, but it is closed by cap 30.

As shown in FIG. 9, the liquid is dispensed in a spray or stream S by manually squeezing gripping portions 22 and 23 together so that the scissor arrangement formed by first ends 13–14 and second ends 12 and 15 expands and hinges 16–19 open to wider angles. This expansion of the scissor arrangement moves cup 8 upwardly so that flexible container 28 is pressed against the upper interior of cover 31. This compression of flexible container 28 causes liquid to be pushed through an opening (not shown) in spout 29 from which cap 30 has been removed. After liquid dispensing is completed, the pressure applied to gripping portions 22 and 23 may be released so that the dispenser components return to their positions shown in FIG. 8.

Although the invention has been described in detail for the purpose of illustration, it is understood that such detail is solely for that purpose and that variations can be made therein by those skilled in the art without departing from the spirit and scope of the invention.

What is claimed:

1. A dispenser for a product comprising:

a container defined by a plurality of walls with opening means at the lower end thereof:

a cup adapted to support said product to be dispensed from said container, wherein said cup is slidably supported within said container;

delivery means to slidably move said cup within said container, said delivery means including a first arm and a second arm each having a first end and a second end with both said first ends connected to said cup, said first arm and said second arm extending downwardly within said container beneath said cup so that said cup is advanced upwardly within said container by pushing the second ends of said first and second arms together; and manipulation means disposed adjacent the opening means of said container in a position where application of pressure at said manipulation means through said opening means in a direction substantially normal to the walls of said container moves the second ends of said first and second arms together and advances said cup upwardly.

2. A dispenser for a product according to claim 1, wherein said container has a dispensing opening adapted to permit the product to be dispensed, said dispenser further comprising a cover engageable with said container to close said dispensing opening.

3. A dispenser for a product according to claim 1, wherein the second ends of said first and second arms are positioned in said container to be moved apart to downwardly retract said cup.

4. A dispenser for a product according to claim1, further comprising:

a product positioned in said cup, whereby said product is advanced in said container when said cup is advanced.

5. A dispenser for a product according to claim4, wherein the product is a solid.

6. A dispenser for a product according to claim 4, wherein the product is a liquid.

7. A dispenser for a product according to claim 6, wherein said container has an open upper end over which a cover is securely placed and wherein said liquid product is contained in a flexible bag having an opening through which said liquid product is dispensed when said cup moves upwardly and pushes said flexible bag against said cover.

8. A dispenser for a product according to claim 1, wherein the second ends of said first and second arms are located generally beneath the first ends of said first arm and said second arm, respectively, when said cup and said delivery means are positioned in said container.

9. A dispenser for a product according to claim 8, wherein said first arm and said second arm each have a cup hinge connecting their first ends to opposite sides of said cup.

10. A dispenser for a product according to claim 9, wherein said first and second arms each have an intermediate hinge connecting their first and second ends, said cup hinges and said intermediate hinges are bent within said container so that said first arm and said second arm cross each other.

11. A dispenser for a product according to claim 10, wherein said cup, the first ends of said first and second arms, the second ends of said first and second arms, said cup hinges, and said intermediate hinges are integrally formed.

12. A dispenser for a product according to claim 11, wherein said second arm has an intermediate cutout portion within which said first arm fits when said first arm and said second arm are positioned in crossing relationship.

13. A dispenser for a product according to claim 12, further comprising:

at least two cross bars extending across said cutout portion and perpendicularly to the length of said second arm, whereby, when said first and second arms are in crossing relationship, one cross bar rests on the first end of said first arm and the second end of said first arm rests on another cross bar.

14. A dispenser for a product according to claim 13, further comprising:

limiting means to limit the extent to which said cup is advanced.

15. A dispenser for a product according to claim 14, wherein said limiting means comprises:

a limiting bar attached to the second end of said first arm and engageable with the cross bar upon which the second end of said first arm rests and a limiting projection positioned on the first end of said first arm and engageable with the cross bar which rests on the first end of said first arm.

16. A dispenser for a product according to claim 15, wherein said manipulation means is positioned at the second end of said first and second arms and has gripping portions of triangular cross section to facilitate upward advancement of said cup.

17. A dispenser for a product according to claim 16, wherein said opening means is sized to retain said gripping portions within said container.

18. A dispenser for a product according to claim 16, wherein said cup, the first and second ends of said first arm, the first and second ends of said second arm, said cup hinges, said intermediate hinges, said cross bars, said limiting bar, said limiting projection, and said gripping portions are integrally formed from the same material.

19. A dispenser for a product according to claim 18, wherein said material is plastic.

20. A dispenser for a product comprising:

a container;

a cup adapted to support said product to be dispensed from said container, wherein said cup is slidably supported by said container; and delivery means to slidably move said cup within said container comprising:

a first arm with a first end and a second end connected together by a first intermediate hinge;

a first cup hinge connecting the first end of said first arm to said cup;

a second arm with a first end and a second end connected together by a second intermediate hinge; and a second cup hinge connecting the first end of said second arm to said cup on a side of said cup opposite said first cup hinge, said first and second arms extend downwardly within said container with said first and second cup hinges and said first and second intermediate hinges bent so that the first ends of said first and second arms cross in sliding relationship to each other and the second ends of said first and second arms cross in sliding relationship to each other, whereby said cup is advanced upwardly within said container by squeezing the second ends of said first and second arms together.

21. A dispenser for a product according to claim 20, wherein said cup, the first and second ends of said first arm, the first and second ends of said second arm, said cup hinges, and said intermediate hinges are all integrally formed.

22. A dispenser for a product according to claim 20, wherein said container has a dispensing opening adapted to permit dispensing the product, said dispenser further comprising a cover engageable with said container to close said dispensing opening.

23. A dispenser for a product according to claim 20, wherein the second ends of said first and second arms are positioned in said container to be moved apart to downwardly retract said cup.

24. A dispenser for a product according to claim 20, further comprising:

a product positioned in said cup, whereby said product is advanced in said container when said cup is advanced.

25. A dispenser for a product according to claim 24, wherein the product is a solid.

26. A dispenser for a product according to claim 24, wherein the product is a liquid.

27. A dispenser for a product according to claim 26, wherein said container has an open upper end over which a cover is securely placed and said liquid product is contained in a flexible bag having an opening through which said liquid product is dispensed when said cup moves upwardly and pushes said flexible bag against said cover.

28. A dispenser for a product according to claim 20, wherein said second arm has an intermediate cutout portion within which said first arm fits when said first arm and said second arm are positioned in crossing relationship.

29. A dispenser for a product according to claim 28, further comprising at least two cross bars extending across said cutout portion and perpendicularly to the length of said second arm, whereby, when said first and second arms are in crossing relationship, one cross bar rests on the first end of said first arm and the second end of said first arm rests on another cross bar.

30. A dispenser for a product according to claim 29, further comprising:

limiting means to limit the extent to which said cup is advanced.

31. A dispenser for a product according to claim 30, wherein said limiting means comprises:

a limiting bar attached to the second end of said first arm and engageable with the cross bar upon which the second end of said first arm rests and a limiting projection positioned on the first end of said first arm and engageable with the cross bar which rests on the first end of said first arm.

32. A dispenser for a product according to claim 31, wherein the second ends of said first and second arms have gripping portions of triangular cross section to facilitate manual advancement and retraction of said cup.

33. A dispenser for a product according to claim 32, wherein said cup, the first and second ends of said first arm, the first and second ends of said second arm, said cup hinges, said intermediate hinges, said cross bars, said limiting bar, said limiting projection, and said gripping portions are all integrally formed from the same material.

34. A dispenser for a product according to claim 33, wherein said material is plastic.

* * * * *